US006056070A

United States Patent [19]

Shinohara et al.

[11] Patent Number: 6,056,070

[45] **Date of Patent: *May 2, 2000**

[54] HYDRAULIC RAMMING APPARATUS

[75] Inventors: Shigeru Shinohara; Takayuki Muto; Mitsuru Arai, all of Tochigi, Japan

[73] Assignee: Komatsu Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/973,781

[22] PCT Filed: Jul. 5, 1996

[86] PCT No.: PCT/JP96/01882

§ 371 Date: Jan. 5, 1998

§ 102(e) Date: Jan. 5, 1998

[87] PCT Pub. No.: WO97/02386

PCT Pub. Date: Jan. 23, 1997

[30] Foreign Application Priority Data

Jul. 6, 1995 [JP] Japan ..... 7-171085

[51] Int. Cl.[7] ..... B25D 9/16

[52] U.S. Cl. ..... 173/128; 173/29; 173/133; 173/211

[58] Field of Search ..... 173/132, 133, 173/128, 118, 29, 171, 210, 211

[56] References Cited

U.S. PATENT DOCUMENTS

| | | | |
|---|---|---|---|
| 2,533,988 | 12/1950 | Bamberger | 173/132 |
| 2,609,813 | 9/1952 | Maurer et al. | 173/118 |
| 2,949,909 | 8/1960 | Macchioni | 173/132 |
| 3,049,109 | 8/1962 | Schley | 173/118 |
| 3,302,731 | 2/1967 | Perry | 173/132 |
| 4,018,291 | 4/1977 | Anderson | 173/DIG. 2 |
| 4,548,278 | 10/1985 | Gidlund | 173/121 |
| 4,886,128 | 12/1989 | Roemer | 173/133 |
| 4,906,049 | 3/1990 | Anderson | 173/133 |
| 4,930,584 | 6/1990 | Chaur Ching | 173/133 |
| 5,095,998 | 3/1992 | Hesse | 173/133 |
| 5,125,462 | 6/1992 | Hesse | 173/133 |
| 5,392,865 | 2/1995 | Piras | 173/207 |
| 5,520,254 | 5/1996 | Weber | 173/206 |

FOREIGN PATENT DOCUMENTS

| | | |
|---|---|---|
| 63-14653 | 1/1988 | Japan . |
| 63-56705 | 4/1988 | Japan . |
| 25410 | 1/1990 | Japan . |
| 6-21923 | 6/1994 | Japan . |
| 7-216864 | 8/1995 | Japan . |

*Primary Examiner*—Peter Vo
*Assistant Examiner*—James Calve
*Attorney, Agent, or Firm*—Wenderoth, Lind & Ponack, L.L.P.

[57] ABSTRACT

A hydraulic ramming apparatus including an apparatus body (14) having a cylinder bore (23) and a guide bore (24) that are successively formed to each other in the apparatus body (14). A piston (30) is slidably inserted into the cylinder bore (23) so as to be reciprocable within the cylinder bore (23). An upper pressure-receiving chamber (31) is defined at an upper end portion side of the piston (30), and a lower pressure-receiving chamber (32) is defined at a lower end portion side of the piston (30). A ramming tool (19), having a rod body (35), can be detachably inserted into the guide bore (24). Also, a mechanism for moving the rod body (35) is provided so as to follow upward movement of the piston (30).

8 Claims, 15 Drawing Sheets

HYDRAULIC RAMMING APPARATUS

TECHNICAL FIELD

The present invention relates to a hydraulic ramming apparatus for ramming and use in a state in which it is attached to an arm or the like of a hydraulic shovel-type excavator.

BACKGROUND ART

As a hydraulic ramming apparatus, various types of ramming apparatus (devices) are well known.

For example, a hydraulic ramming apparatus disclosed in Japanese Utility Model Publication No. Hei 6-21923 is well known. In this hydraulic ramming apparatus, a piston is slidably inserted into a cylinder bore formed in an apparatus (device) body so as to enable the piston to vertically move within the cylinder bore, and to thereby define an upper pressure chamber and a lower pressure chamber. In addition, the piston is protruded downwardly from the device body, and a ramming plate is attached to the protruded end portion thereof. Further, a change-over valve for switching circuits of pressurized oil is provided in the device body.

In the hydraulic ramming apparatus, when the change-over valve is switched by the vertical movement of the piston and the pressurized oil is alternately supplied to or discharged from the upper pressure chamber and the lower pressure chamber to vertically move the piston, the ramming plate is vertically moved to thereby ram or compact the ground.

However, in the hydraulic ramming apparatus thus constructed, since the ramming plate is attached to the protruded end portion of the piston which is vertically movable by the hydraulic pressure, the ramming apparatus is applied to only the ramming or compacting work and the apparatus is not available, for example, for crushing work using a chisel.

That is, in a case where rocks or the like are crushed by utilizing the chisel, when the chisel in a state of being abutted against rocks or the like is hammered by the vertical movement of the piston and impact points on the rock by the chisel is converged to one point, the rocks or the like can be efficiently crushed.

However, as described above, when the chisel is attached to the protruded end portion of the piston, the chisel is liable to vertically move together with the piston, and the impact points of the chisel against the rock are apart from each other in every hammering operation and thus the impact points cannot be converged, so that it is difficult to efficiently crush the rocks.

In addition, in the hydraulic ramming apparatus described above, there may be posed a problem that a lateral force is liable to be applied onto a sliding portion of the piston and the lateral force will damage the sliding portion of the piston, which may result in oil leakage.

Namely, when the ground is subjected to the ramming operation by using the vertically moving ramming plate, the lateral force other than upward reactive force is also applied to the ramming plate due to irregularities of the ground. The lateral force is transmitted to the piston, and the piston is obliged to vertically slide within the cylinder bore while the piston is obliquely impressed to the cylinder bore formed in the device body, so that there may be a case where the sliding portion of the piston is damaged. When the sliding portion of the piston is damaged, there may cause a problem that the pressurized oil charged in the upper and lower pressure chambers leaks, thus resulting deteriorated reliability of the device.

In addition, the piston of the above-mentioned hydraulic ramming apparatus comprises the sliding portion and the protruded end portion, so that an entire length of the piston will become large and it requires significant amounts of time to work and assemble the piston system.

That is, the sliding portion of the piston is required to be subjected to a precision work and a heat-treating work so as to prevent the pressurized oil from leaking therefrom. However, since the entire length of the piston sliding portion long, an initial set-up for the work becomes complicated and will disadvantageously prolong the working time of the piston assembly.

Furthermore, a dimensional tolerance between the piston sliding portion and the cylinder bore is extremely small and both the piston and the cylinder bore are strictly required to be aligned in a straight line and the piston is required to be inserted into the cylinder bore with a high degree of accuracy. However, the entire length of the piston becomes long due to existence of the protruded end portion as described above, so that the inserting operation cannot be performed easily which prolongs the assembling time for the device.

Therefore, the present invention is achieved for solving the aforementioned problems and an object of the present invention is to provide a hydraulic ramming apparatus which and is also applicable to a crushing operation using a chisel or the like, and is substantially free from the oil leakage and enables the working time to be shortened and the assembling time.

SUMMARY OF THE INVENTION

In order to achieve the afore-mentioned object, the hydraulic ramming apparatus according to the present invention includes an apparatus body having a cylinder bore and a guide bore that are successively formed to each other in the device body. A piston is slidably inserted in the cylinder bore so as to be reciprocable within the cylinder bore. An upper pressure-receiving chamber is defined at an upper end portion side of the piston, and a lower pressure-receiving chamber is defined at a lower end portion side of the piston. A ramming tool, having a rod body, is detachably inserted into the guide bore and a mechanism for moving the rod body is provided so as to follow upward movement of the piston.

Further, the mechanism for moving the rod body so as to follow the piston is constructed to be detachable, and the guide bore is formed so as to allow the end portion of the chisel to be detachably inserted into the guide bore in place of the ramming tool.

In the construction described above, since the piston and the rod body of the ramming tool are separately formed, it becomes possible to insert the end portion of the chisel in place of the rod body, and thus the apparatus can be available not only for a ramming operation but also for a crushing operation.

Further, on the basis of the same reason, even if the rod body is inclined against an elastic force of an elastic member when a lateral force is applied to the ramming tool during the ramming working, the lateral force will not be transmitted to the piston, so that the sliding portion of the piston will not be damaged.

Furthermore, the piston can be individually worked under a condition of being separated from the ramming tool, and the piston can also be individually inserted into the cylinder bore, so that it becomes possible to shorten the working time and the assembling time of the device.

The following are examples of the mechanism for moving the rod body so as to follow the piston described above, 1) a spring for urging the rod body towards the piston, 2) a hydraulic cylinder device is provided between the rod body and the device body, and 3) a flexible cylindrical body for connecting the rod body and the end portion of the piston are preferable.

In this regard, the spring can be attached in such a manner that the spring is interposed between a spring receiving portion and a spring receiver which is slidably inserted in the rod body and is formed to be engageable with the device body. Then the spring receiver is engaged with or disengaged from the device body while the spring is in a state of being compressed.

In another way, the spring can also be attached in such a manner that the spring is interposed between a spring receiving portion and a guide ring which is slidably inserted into the rod body and is formed to be engageable with the device body. A removable ring is then fitted to a position of the rod body, the position being outside the guide ring, thereby to compress the spring, and the guide ring together with the compressed spring are attached to the device body, thereafter the removable ring is removed from the rod body.

Further, in the construction described above, it is preferable to construct the apparatus in such a manner that an elongated recessed portion is provided at the rod body, and a pin positioned in a direction normal to the rod body is rotatably fitted into the device body so that the pin passes through the elongated recessed portion, thereby to allow an outer circumferential surface of the pin to contact the surface of the elongated recessed portion. In another way, it is preferable that the elongated recessed portion is provided at the rod body, and a supporting shaft oriented in a direction normal to the rod body is rotatably fitted to the device body, and a roller is rotatably fitted to the supporting shaft so that the roller passes through the elongated recessed portion, thereby to allow an outer circumferential surface of the roller to contact with the surface of the elongated recessed portion and not to contact the device body.

Furthermore, in the construction described above, the ramming apparatus can also be constructed so that the upper pressure chamber is connected to a hydraulic tank through a change-over valve and a restrictor. In this construction, when the rod body of the ramming tool is inserted into the guide bore, the change-over valve is switched and the upper pressure-receiving chamber is connected to the hydraulic tank through the restrictor, while at any other time, the upper pressure chamber is cut off from the hydraulic tank.

As another way, the apparatus can also be constructed so that an auxiliary pressure-receiving chamber is connected to the upper pressure-receiving chamber and the auxiliary pressure-receiving chamber is also connected to the hydraulic tank through the change-over valve and the restrictor. In this construction, when the rod body of the ramming tool is inserted into the guide bore, the change-over valve is switched whereby the auxiliary pressure-receiving chamber is connected to the hydraulic tank through the restrictor, while at any other time, the auxiliary pressure-receiving chamber is directly connected to the hydraulic tank.

BRIEF DESCRIPTION OF THE DRAWINGS

The present invention will become more apparent and more easily understood from the following detailed description when taken in conjunction with the accompanying drawings in which preferred embodiments of the present invention are shown by way of illustrative examples.

Further, the embodiments shown in the accompanying drawings are not for specifying or limiting the scope of the present invention, but are merely for facilitating the explanation and understanding of this invention.

In the accompanying drawings:

Figure 1:
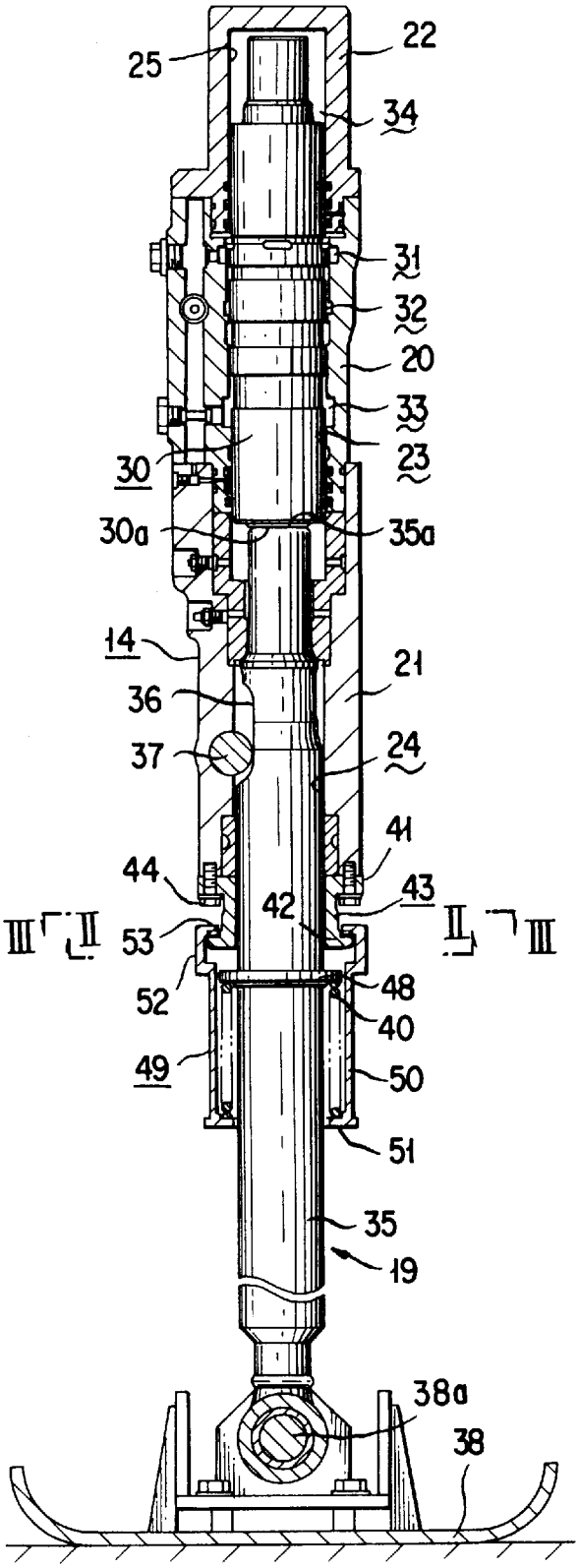
Figure 2:
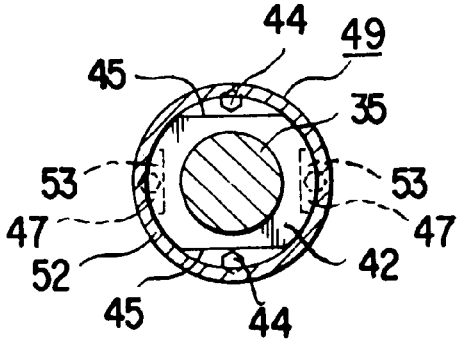
Figure 3:
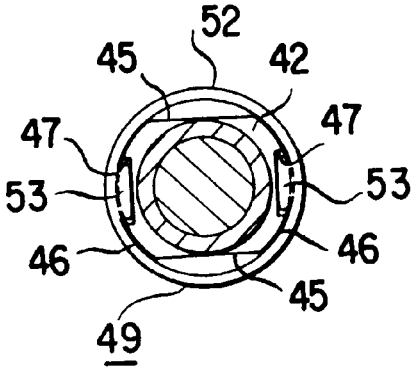
Figure 4:
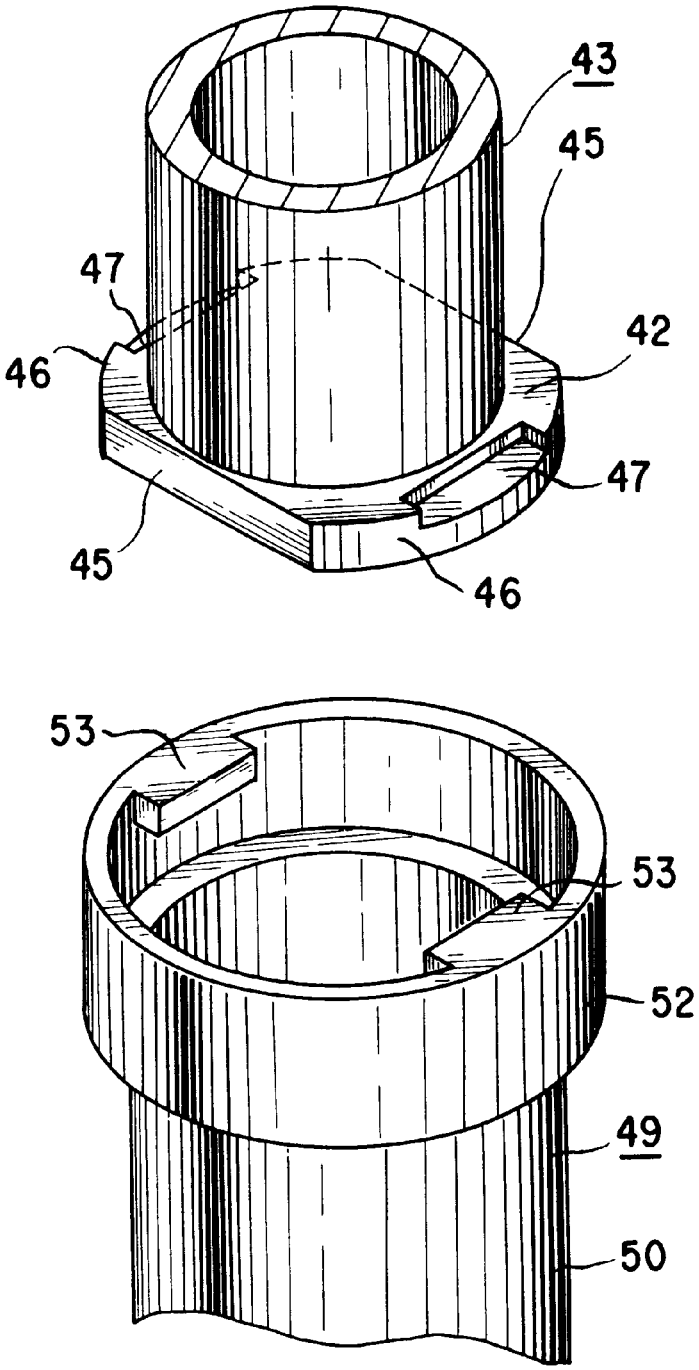
Figure 5:
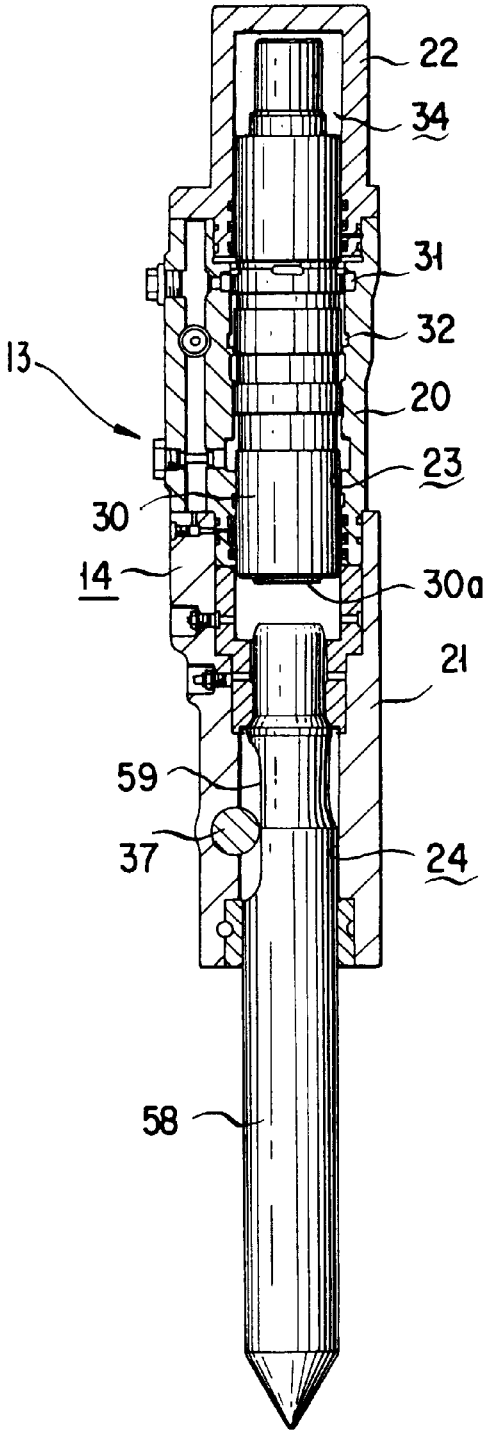
Figure 6:
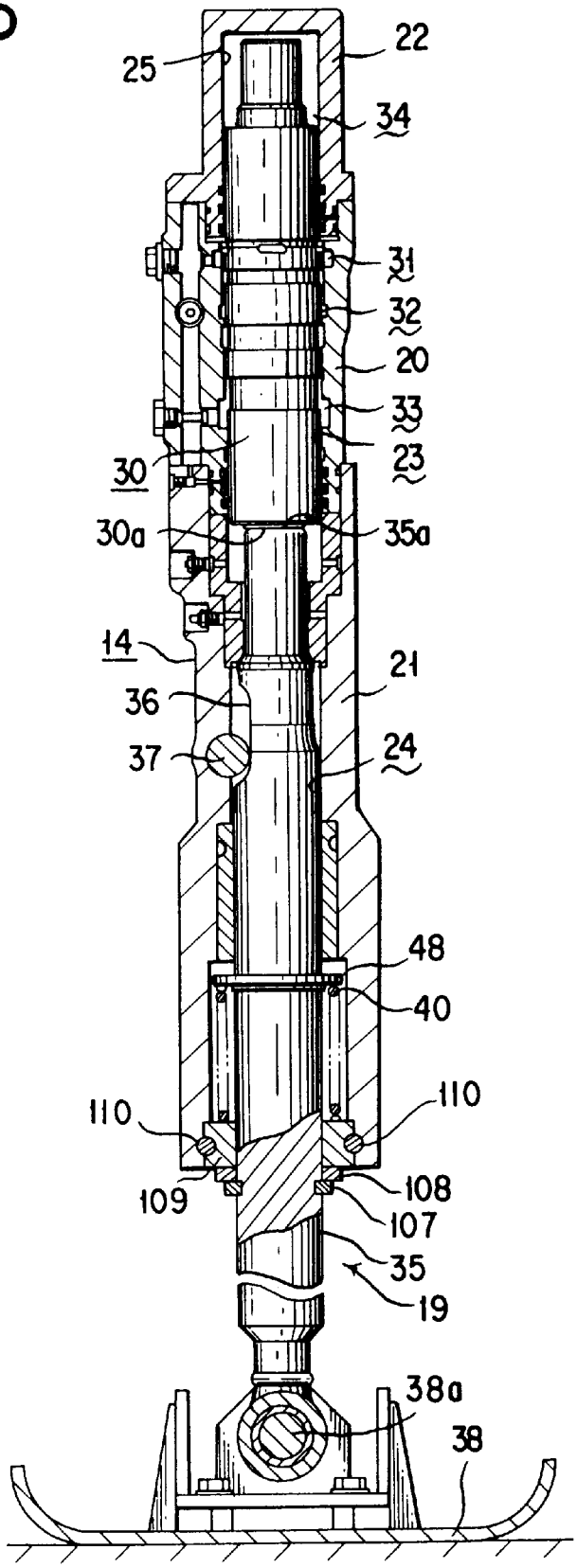
Figure 7:
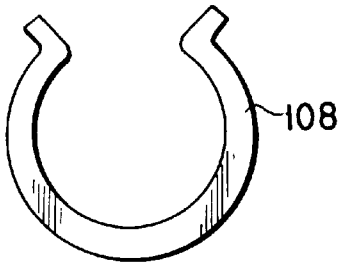
Figure 8:
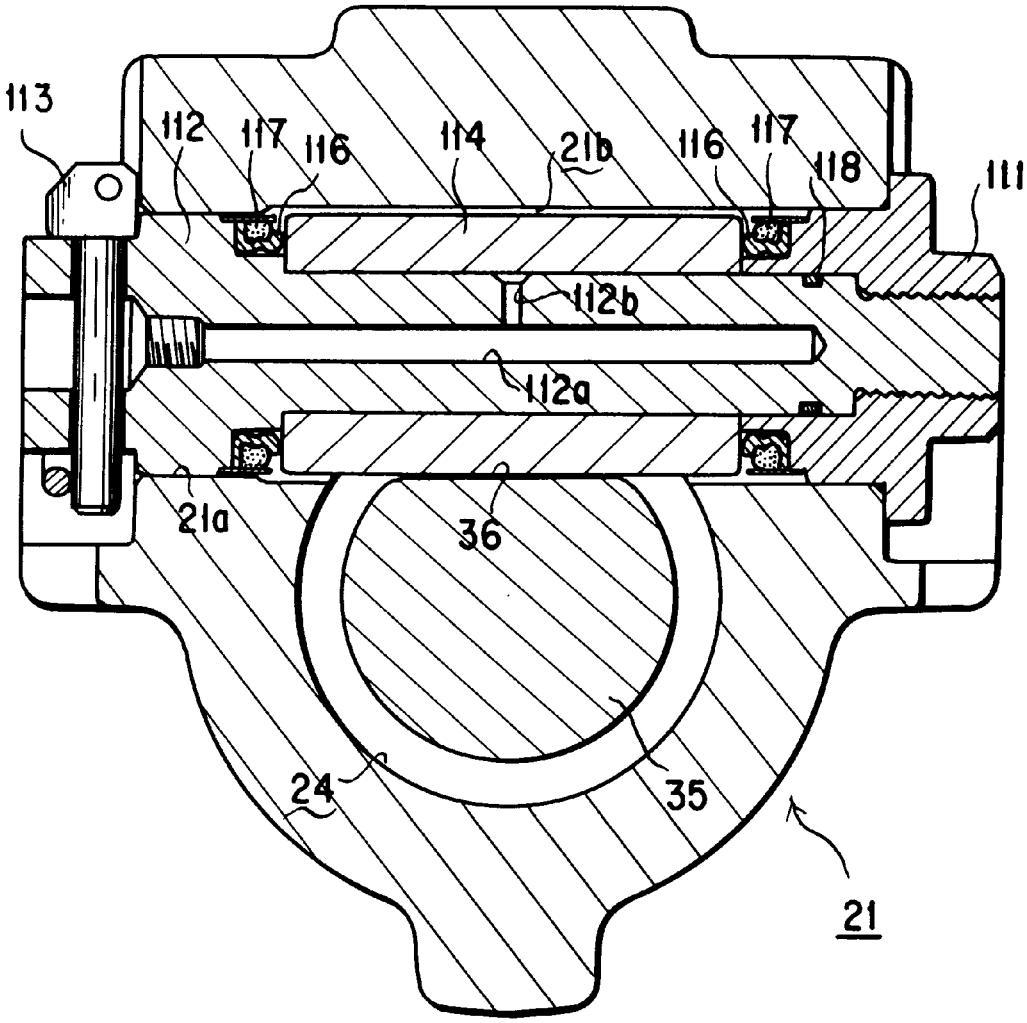
Figure 9:
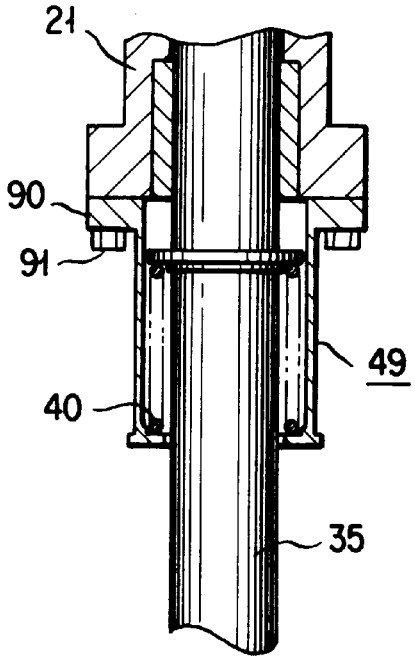
Figure 10:
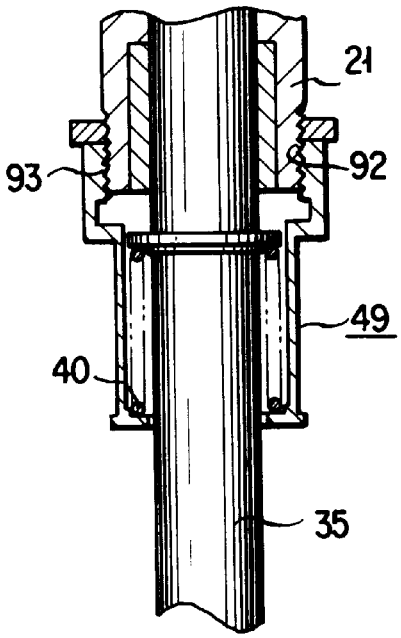
Figure 11:
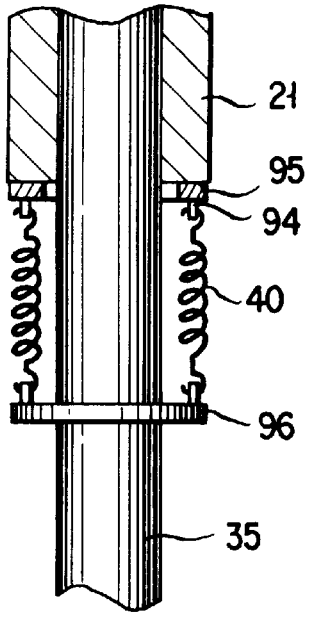
Figure 12:
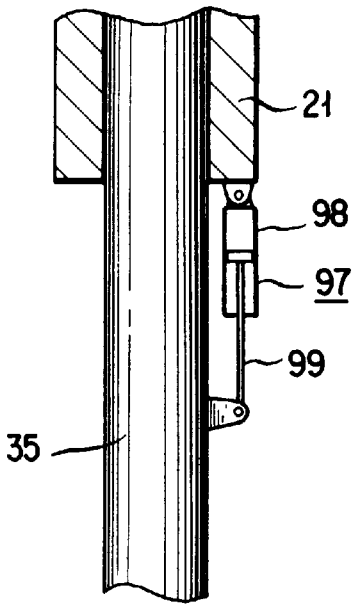
Figure 13:
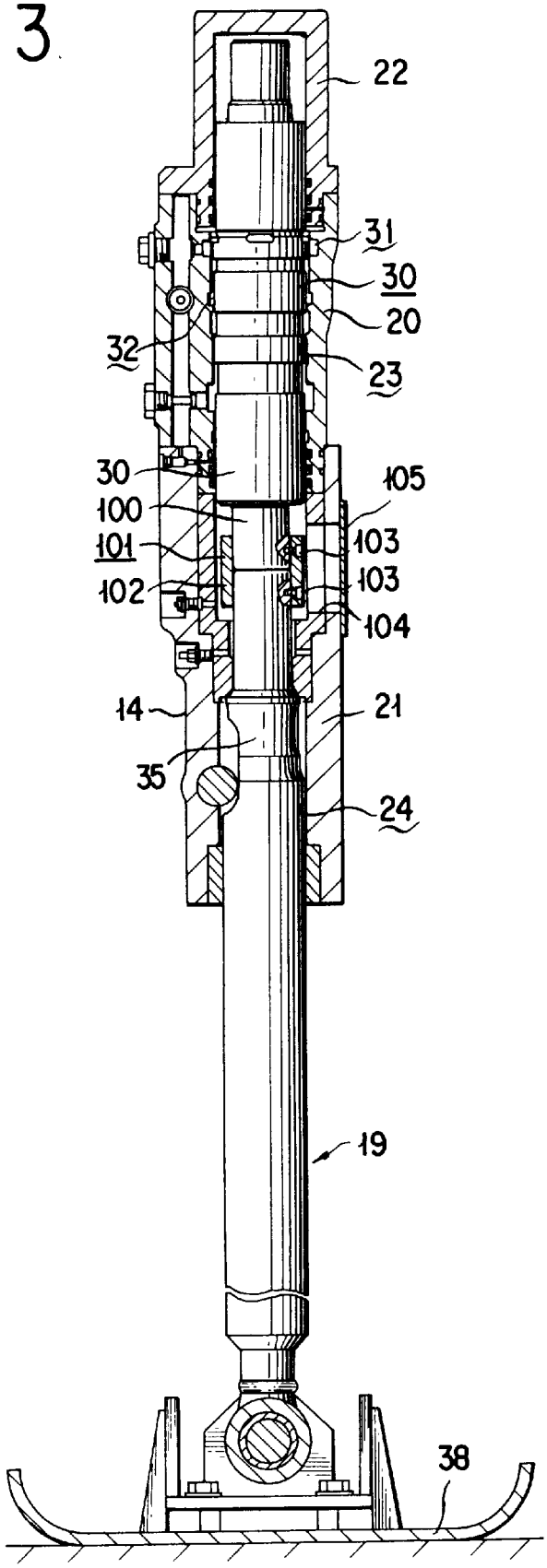
Figure 14:
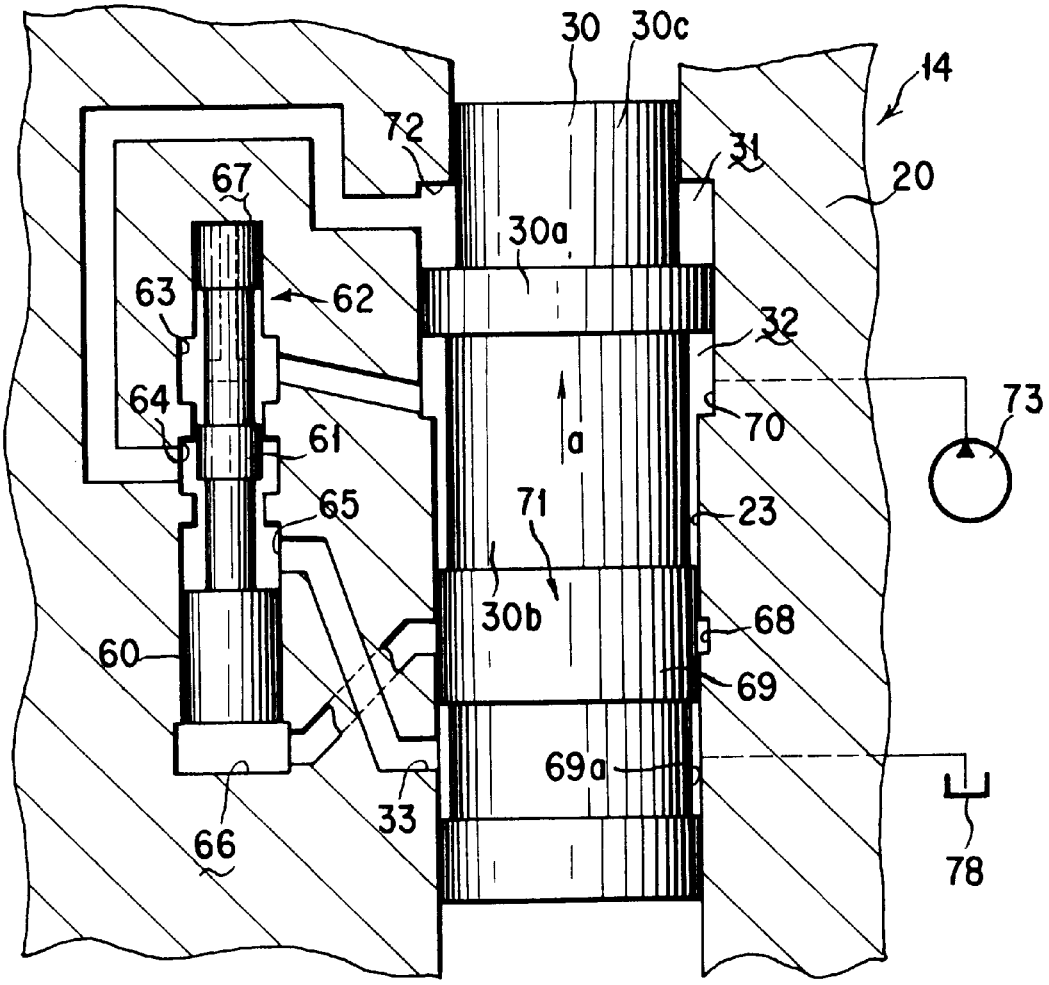
Figure 15:
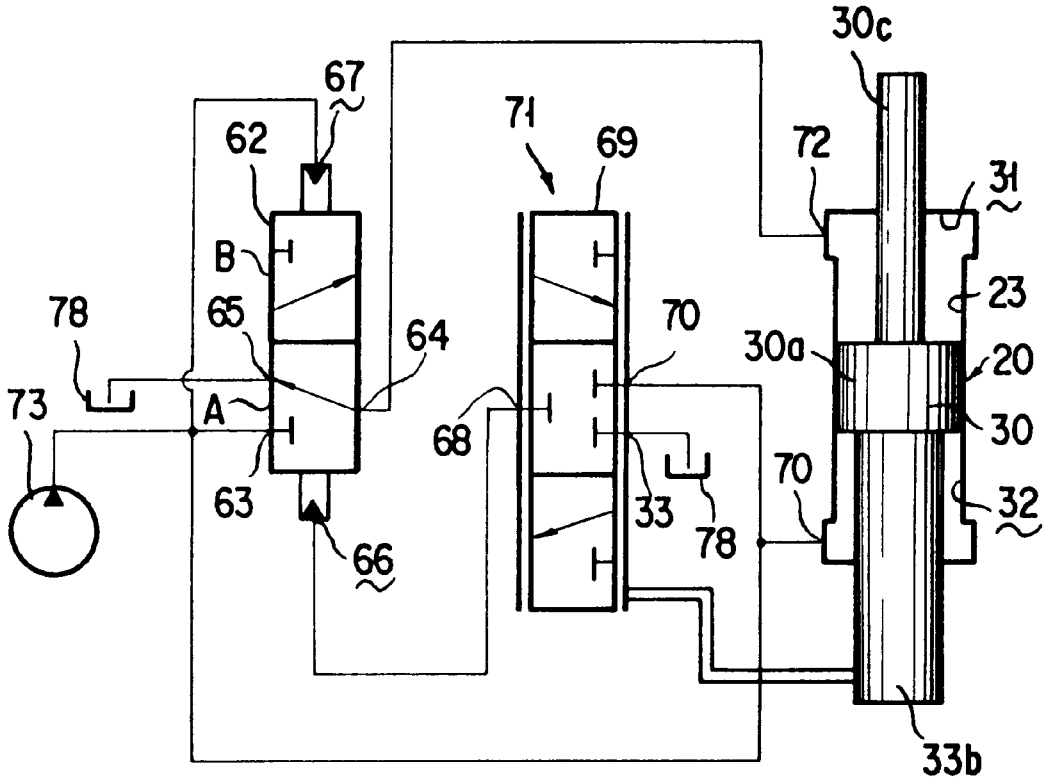
Figure 16:
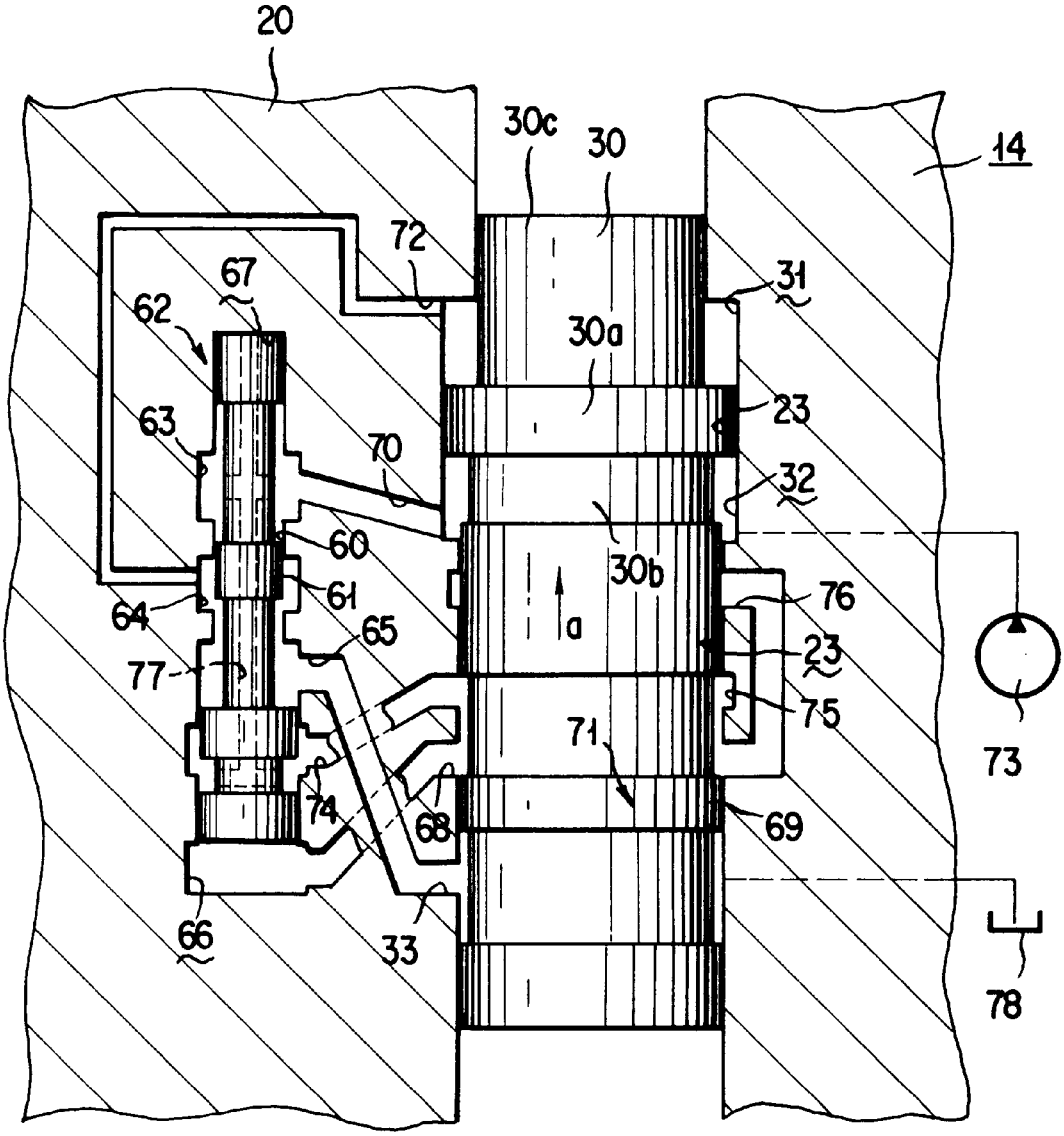
Figure 17:
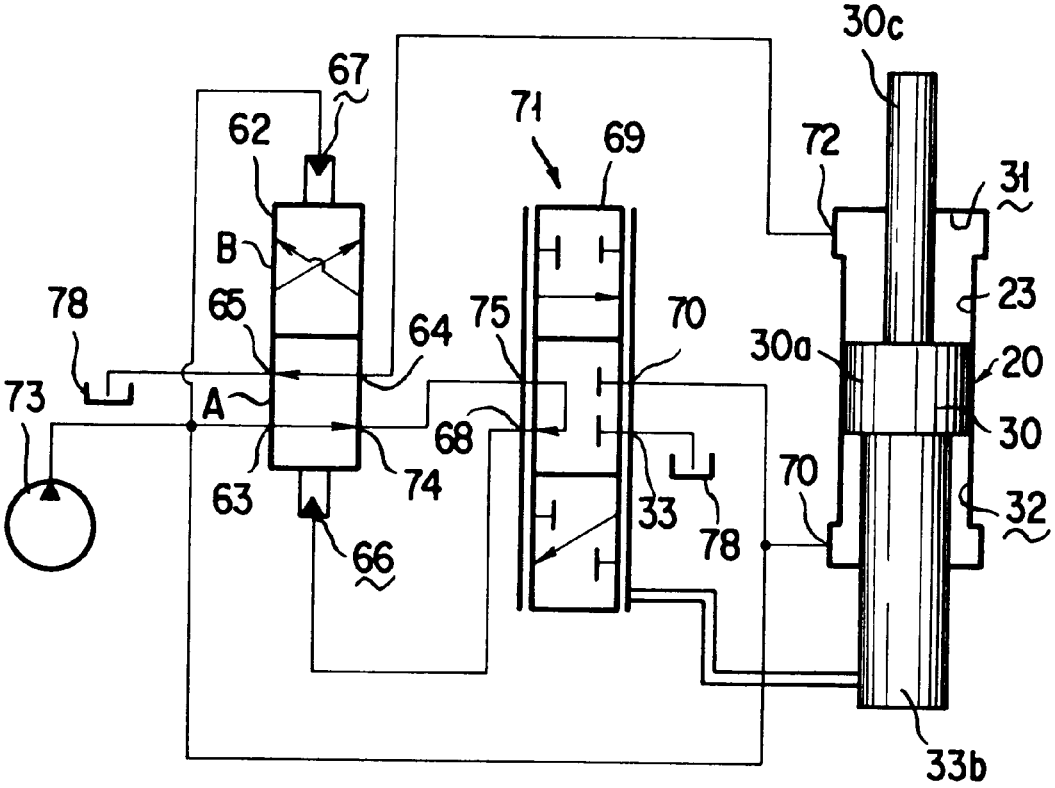
Figure 18:
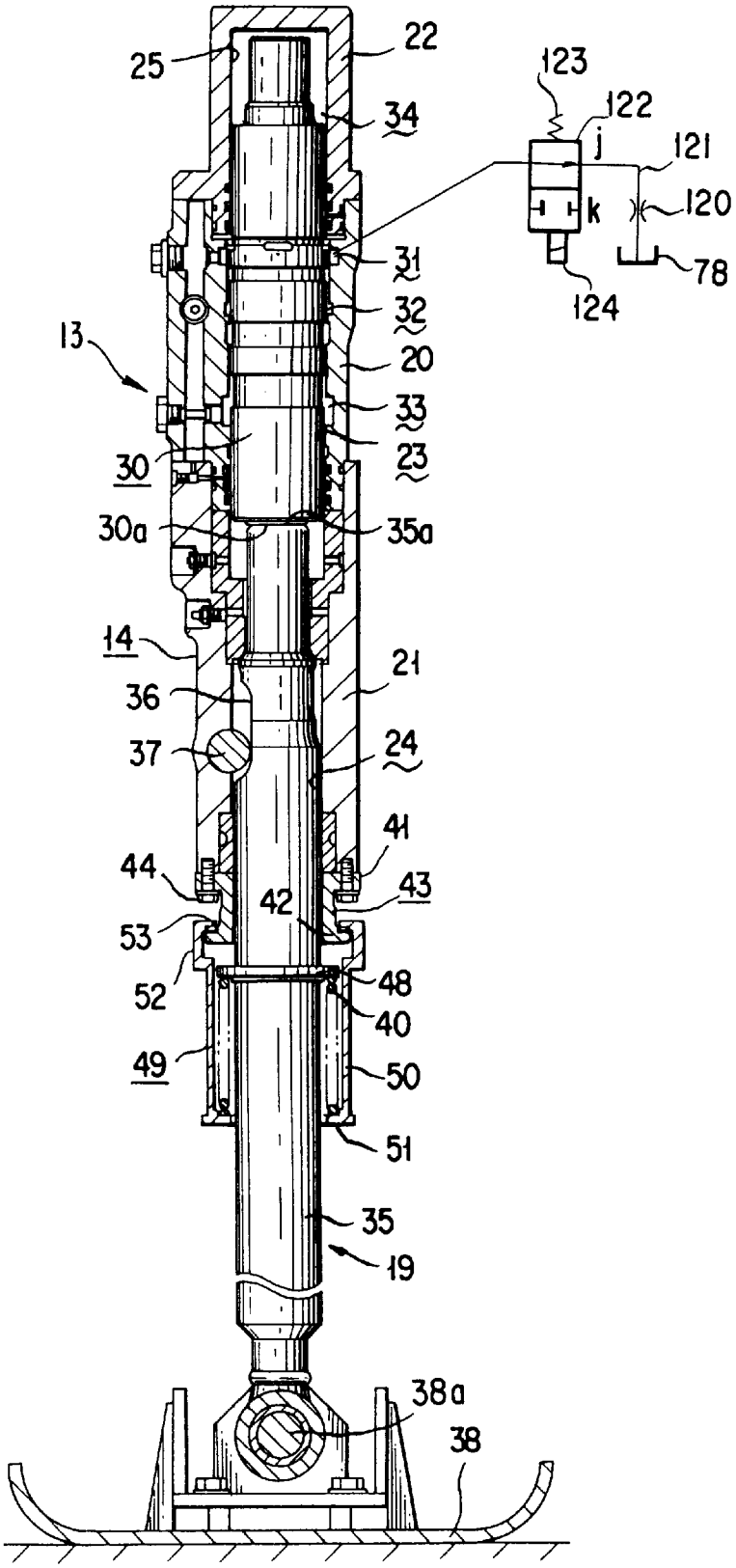
Figure 19:
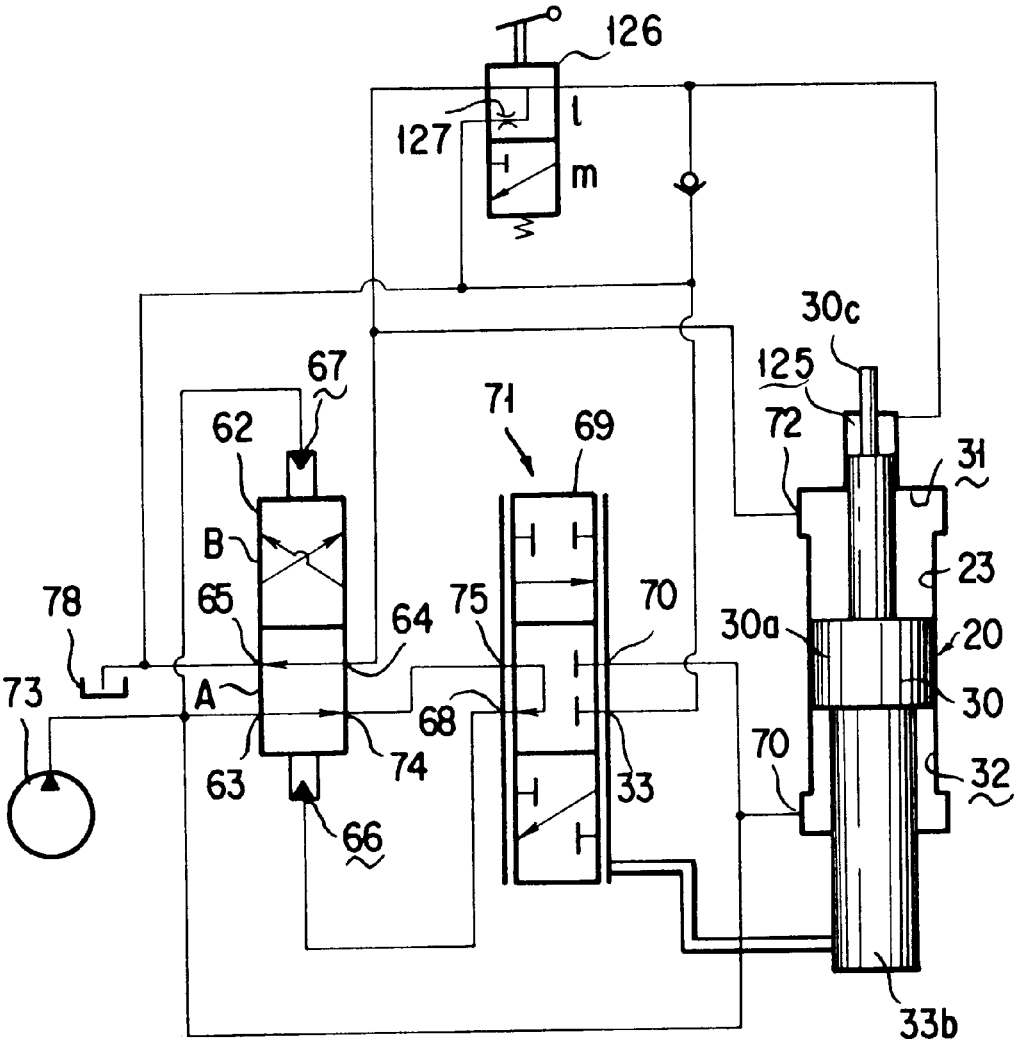

FIG. 1 a longitudinal sectional view showing one embodiment of a hydraulic ramming apparatus according to the present invention;

FIG. 2 is a sectional view taken along the line II—II of FIG. 1;

FIG. 3 is a sectional view taken along the line III—III of FIG. 1;

FIG. 4 is an exploded perspective view showing a first example of a spring mounting portion used in the embodiment shown in FIG. 1;

FIG. 5 is a sectional view showing an embodiment in which a chisel is attached;

FIG. 6 is a sectional view showing a second example of a spring mounting portion;

FIG. 7 is a plan view showing a detachable ring of the spring mounting portion shown in FIG. 6;

FIG. 8 is a view showing a cross sectional portion close to an elongated recessed portion of a rod body in a hydraulic ramming apparatus;

FIG. 9 is a sectional view showing a third example of a spring mounting portion;

FIG. 10 is a sectional view showing a fourth example of a spring mounting portion;

FIG. 11 is a sectional view showing a fifth example of a spring mounting portion;

FIG. 12 is a sectional view showing a sixth example of a hydraulic cylinder mounting portion corresponding to a spring mounting portion;

FIG. 13 is a sectional view showing another example of a structure for a rod body to follow up to a piston;

FIG. 14 is a sectional view showing a first example of a mechanism for vertically moving a piston;

FIG. 15 is a schematic view showing a first example of a mechanism for vertically moving a piston;

FIG. 16 is a sectional view showing a second example of a mechanism for vertically moving a piston;

FIG. 17 is a schematic view showing a second example of a mechanism for vertically moving a piston;

FIG. 18 is a view showing a longitudinal section of a third example of a mechanism for vertically moving a piston; and FIG. 19 is a schematic view showing a principal structure of a fourth example used in a mechanism for vertically moving a piston.

DETAILED DESCRIPTION OF THE INVENTION

The preferred embodiments of the hydraulic ramming apparatus (device) according to the present invention will now be described with reference to the accompanying drawings.

As shown in FIG. 1, an apparatus (device) body 14 comprises an upper body 20, a lower body 21 fitted to a lower end portion of the upper body 20 and a cap body 22 is fitted to an upper end portion of the upper body 20. A cylinder bore 23 is formed in the upper body 20 so as to vertically pass through the upper body 20, and a guide bore 24 is formed in the lower body 21 so as to vertically pass through the lower body 21, while the cap body 22 is provided with a bore 25. The bore 25, the cylinder bore 23 and the guide bore 24 are coaxially connected to each other.

A piston 30 is slidably inserted into the cylinder bore 23 so that an upper pressure-receiving chamber 31, a lower pressure-receiving chamber 32 and a drain port 33 are defined. Further, an upper end portion of the piston 30 is slidably inserted into the bore 25 of the cap body 22. In this connection, for the purpose of increasing the speed of the piston 30 moving downwardly, a chamber 34 formed in the bore 25 may be filled with nitrogen gas or the like so that the piston is pushed downwards. The piston 30 may also be pushed downwards by the action of a spring, not shown.

An upper end portion of a rod body 35 is slidably inserted into the guide bore 24 enabling the rod body to vertically move within the guide bore 24. A longitudinal elongated recessed portion 36 is formed at a side surface of a top end portion of the rod body 35. A pin 37, extending in a direction normal to the lower body 21, is provided so as to pass through the elongated recessed portion 36. The pin prevents rotation of the rod body 35 so that the rod body can not rotate around a central axis thereof. The lower end portion of the rod body 35 protrudes downwards from the lower end portion of the lower body 21, and a ramming plate 38 is detachably attached to the protruded portion by means of a pin 38*a*, thus constituting a ramming tool 19.

The rod body 35 described above is upwardly pushed or biased by means of an elastic member such as spring 40 so that the upper end surface 35*a* of the rod body 35 normally abuts against the lower end surface 30*a* of the piston 30. When the piston 30 is vertically moved, the rod body 35 is also vertically moved so as to follow the piston 30, so that the ramming plate 38 is vertically moved thereby to ram the ground.

In this regard, if the spring 40 is not provided, the rod body 35 will move downwards due to its own weight, and the upper end surface 35*a* of the rod body 35 will be apart from the lower end surface 30*a* of the piston 30 when the piston 30 is moved upwards. As a result, the piston 30 is vertically moved while the ramming plate 38 is held in a state of being in contact with the ground, so that it is impossible to ram the ground by vertically moving the ramming plate 38.

Next, a first example of an attachment structure of the spring 40 will be explained.

As shown in FIG. 1, a cylindrical body 43 having an upper flange 41 and a lower flange 42 is attached to the lower end surface of the lower body 21 by fastening the upper flange 41 by means of bolts 44. As shown in FIGS. 2, 3 and 4, the lower flange 42 of the cylindrical body 43 has a pair of straight-line-shaped outer surfaces 45, and a pair of circular-arc-shaped outer surfaces 46. The paired straight-line-shaped outer surfaces 45 are formed at portions to be rotatively symmetric to each other at a symmetric angle of 180° with respect to a center of the lower flange 42. The paired circular-arc-shaped- outer surfaces 46 are formed at portions rotated at an angle of 90° from the straight-line-shaped outer surfaces 45, and the paired circular-arc-shaped outer surfaces 46 are rotatively symmetric at 180° with respect to the center of the lower flange 42. In addition, an engaging recessed portion 47 is formed at an upper portion of respective circular-arc-shaped outer surfaces 46.

As shown in FIG. 1, at an almost central portion of the rod body 35, a ring-shaped spring receiving portion 48 is provided. The spring receiving portion 48 can be integrally formed with the rod body 35, or separately formed and attached to the rod body 35 by means of bolts, pin or the like.

As shown in FIG. 1, a cylindrical spring receiver 49 comprising a small sized cylinder 50 and a large sized cylinder 52 integrally formed with an upper portion of the small sized cylinder 50 is loosely engaged with the lower end portion of the rod body 35. The spring receiver 49 has a ring-shaped protrusion 51 integrally formed on an inner surface of the lower portion of the small sized cylinder 50, while a pair of engaging protruded portions 53 are integrally formed on an inner surface of the upper portion of the large sized cylinder 52. The engaging protruded portions 53 are formed at portions to be rotatively symmetric to each other at a symmetric angle of 180°. When the engaging protruded portions 53 are engaged with engaging recessed portions 47 formed in the lower flange 42 of the cylinder body 43, the spring receiver 49 is connected to the cylinder body 43 so as not to rotate. Further, a spring 40 is interposed between the ring-shaped protrusion 51 and the spring receiving portion 48 thereby to push up the rod body 35 by the action of the urging force of the spring 40.

Next, an operation for inserting the rod body 35 into the lower body 21 will be explained.

At first, under a state where the ramming plate 38 is detached from the rod body 35, the spring receiver 49 is inserted into the lower portion of the rod body 35, and the spring 40 is provided between the ring-shaped protrusion 51 and the spring receiving portion 48.

Then, when the upper end portion of the rod body 35 is inserted into the guide bore 24 of the lower body 21, the pin 37 is rotatably fitted into the lower body 21 so as to pass through the elongated recessed portion 36 thereby to lock the rod body 35 so as to prevent rotation. Subsequently, the positions of the paired engaging protruded portions 53 of the spring receiver 49 are adjusted so that the engaging protruded portions 53 face the paired straight-line-shaped outer surfaces 45. Thereafter, the spring receiver 49 is moved upwards while the spring 40 is compressed, and the positions of the paired engaging protruded portions are adjusted so as to be higher than that of the lower flange 42.

In such a state, the spring receiver 49 is rotated around a central axis at a rotation angle of 90°, and the positions of the paired engaging protruded portions 53 are adjusted to those of the engaging recessed portions 47. In this state, when a worker detaches his hand from the spring receiver 49, the spring receiver 49 moves downwards by the action of the urging force of the spring 40. As the result, the paired engaging protruded portions 53 are engaged with the engaging recessed portions 47 respectively, and the cylinder body 43 is connected to the spring receiver 49.

In this regard, in a case where the rod body 35 is required to be drawn out, it is sufficient to perform works in reverse to those described above.

Further, as shown in FIG. 5, after the rod body 35 is drawn out from an apparatus body 14 of a vibration generator 13, when a base end portion of a chisel 58 is inserted into the guide bore 24 of the lower body 21, then the chisel 58 is locked by means of the pin 37, the chisel 58 moves downwards under its own weight and the upper end surface of the chisel 58 is spaced apart from the lower end surface 30*a* of the piston 30. In this state, when the piston 30 is vertically moved, the piston 30 repeatedly strikes the base end portion of the chisel 58, thus enabling a crushing operation to be performed. As a result, the working device of this invention can also be used as an ordinary chisel-type breaker.

By the way, the upper end portion of the chisel 58 has the same shape as that of the upper portion of the rod body 35, and a cut-out recessed portion 59 is formed at a side surface of the upper end portion of the chisel 58 for allowing the pin 37 to pass therethrough.

In this regard, in the case of the attachment structure of the spring 40 described above, not only force for lifting the rod body 35 but also force for compressing the spring 40 are required when the rod body 35 is attached or detached. Therefore, a large operation force is disadvantageously required. However, if the following attachment structure (second example) of the spring 40 is adapted, the required operation force can be reduced to a small level.

As shown in FIG. 6, prior to the insertion of the rod body 35 into the guide bore 24, the spring 40 is previously assembled into the rod body 35. Namely, a snap ring 107 is fitted to the lower portion of the rod body 35, and a detaching ring 108 shown in FIG.7 and a guide ring 109 are fitted so that the detaching ring 108 and the guide ring 109 are positioned at a level higher than that of the snap ring 107. A spring 40, in a state of being compressed to have a set length, is interposed between the guide ring 109 and the spring receiver 48. In addition, the guide ring 109 is fitted to the lower portion of the lower body 21. The lock pins 110 are inserted into the boundaries between the guide ring 109 and the lower body 21 whereby the guide ring 109 can from dropping out from the lower portion of the lower body 21.

Accordingly, as described above, after the rod body 35 is inserted into guide bore 24 of the lower body 21, the lock pin 110 is inserted into the boundary portion between the lower end portion of the lower body 21 and the guide ring 109. Finally, when the detachable ring 108 is pulled away, an attaching operation of the rod body 35 to the lower body 21 is completed. At this time, since the operator is required only to lift up the rod body 35, the required operating force can be reduced.

Further, as described above, the pin 37 is passed through the elongated recessed portion 36 formed in a longitudinal direction at the side surface of the upper portion of the rod body 35 so that the pin 37 is fitted in a direction normal to the lower portion 21, thus resulting in a construction in which the rod body 35 can not freely rotate around the central axis thereof.

In a hydraulic ramming apparatus having such a construction, when the apparatus is used for ramming a rough ground, an axial rotating force is generated due to a rotation torque to be caused at the ramming plate 38, to that either one of both corner portions of the elongated recessed portion 36 is pushed to an outer peripheral surface of the pin 37 with an excessively large force, and a reaction force against the excessively large force is applied from the lower body 21 to the pin 37. As the result, the pin 37 will not rotate and the rod body 35 will slide against the pin 37, so that abrasion or wear of both members disadvantageously progresses. In spite of the situation described above, when the pin 37 is obliged to rotate, the pin 37 would slide against the lower body 21 while the pin 37 is applied with the large reaction force from the lower body 21, so that the wear of both members will progress, thereby to pose a problem that the rod body 35 and the pin 37 are damaged in a short period of time.

In addition, when a friction force between the rod body 35 and the pin 37 becomes large, a rotational resistance at the time of the rod body 35 being reciprocated will also become excessive, so that it becomes impossible for the rod body 35 to follow the movement of the piston 30 by depending on only the urging force of the spring 40. As a result, the rod body 35 will disorderly move, so that it may become impossible to perform the ramming work. However, if the following construction is applied, the problems described above will be effectively solved.

FIG. 8 is a cross sectional view showing the construction. In FIG. 8, a lateral bore 21*a* is formed in the lower body 21 so as to pass through the lower body 21 in a direction normal to the rod body 35, and a spindle 112 having a plug 111 with a collar screwed into one end of the spindle 112 is inserted into the lateral bore 21*a*. At the other end of the spindle 112, a ring pin 113 for preventing the spindle 112 from drawing out from the lateral bore 21*a* is attached so as to pass through the spindle 112. In addition, a roller 114 is rotatably supported by a small-sized central portion of the spindle 112, so that an outer peripheral surface of the roller 114 contacts a surface of the elongated recessed portion 36 formed in the rod body 35.

In addition, at a center axial portion of the spindle 112, there is formed a lubricating bore 112*a* into which a lubricating oil is filled. The filled lubricating oil is prevented from leaking by a plug 111 screwed to an end portion of the lubricating bore 112*a*, and the lubricating oil is supplied to a portion between the small-sized central portion of the spindle 112 and the roller 114. At both the sides of the roller 114 i.e., at the ring pin 113 side of the spindle 112 and the inner side of the plug 111, there are attached an oil seal 116 and a retainer ring 117 for retaining the oil seal 116, respectively. Further, an O-ring 118 is fitted and attached to a portion between the one end portion of the spindle 112 and the plug 111. Furthermore, a cutout clearance 21*b* is formed at an inner peripheral portion of the lateral bore 21*a* which is opposed to the rod body 35, so that the outer peripheral surface of the roller 114 does not contact an inner peripheral surface of the lateral bore 21.

According to the construction shown in FIG. 8, when the rod body 35 is reciprocated by the reciprocating movement of the piston 30, the roller 114 also reciprocally rotates due to the reciprocal movement of the rod body 35.

At this time, for example, even in a case where rotary torque is generated at the ramming plate 38 thereby to generate an axial rotating force in the rod body 35 and either one of both corner portions of the elongated recessed portion 36 is strongly pressed onto the outer peripheral surface of the pin 37 with a large excessive force, the roller 114 can freely rotate so as to follow reciprocal movement of the rod body 35 because the cutout clearance 21*b* is formed at the inner peripheral portion of the lateral bore 21*a* which is opposed to the rod body 35 so that the outer peripheral surface of the roller 114 would not contact to the inner peripheral surface of the lateral bore 21.

Accordingly, of course, there is no occurrence of the wear of the inner peripheral surface of the lateral bore 21, and the wear of the roller 114 and the rod body 35 can be also remarkably reduced, and the useful lives of these parts can be prolonged and maintenance work for these parts can also be simplified.

Further, since the roller 114 can freely rotate so as to follow up the reciprocal movement of the rod body 35, a friction force between the rod body 35 and the pin 37 will become small and the rotating resistance of the rod body 35 at the time of reciprocation will also be small. Accordingly, it becomes possible for the rod body 35 to fully follow movement of the piston 30 by the action of only the urging force of the spring 40. As a result, the rod body 35 will not disorderly move and it becomes possible to easily perform the ramming work.

Next, other examples of structures for attaching the spring 40 will be explained.

FIG. 9 shows a third example of the spring attachment structure in which a flange 90 is integrally formed with the spring receiver 49. The flange 90 is directly fastened and fixed to the lower end portion of the lower body 21 by means of bolts 91.

FIG. 10 shows a fourth example of the spring attachment structure in which a female screw portion 92 is formed on an inner surface of an upper end portion of the spring receiver 49 and the female screw portion 92 is engaged to a male screw portion 93 formed on the outer peripheral surface of upper end portion of the lower body 21, so that the spring receiver 49 is attached to the lower body 21.

As another way, FIG. 11 shows a fifth example of the spring attachment structure in which a ring 95 having a plurality of brackets 94 is fixed to the lower end portion of the lower body 21 by means of bolts. A ring 96 for attaching the spring is integrally formed with the rod body 35 or the ring 96 is attached to the rod body 35. Then, the ring 96 and each of the brackets 94 are connected to both ends of the spring 40 respectively, so that the rod body 35 is urged upwards by the force of the spring 40.

In each of the examples described above, the spring is used as an elastic member. However, other elastic members such as a combination formed by combining a plurality of disc springs, a rubber material, resin material having a resiliency can also be used as the elastic member. In this case, these elastic members are attached to the rod body 35 in the same manner as in the case of the spring.

Furthermore, as the other examples of the elastic member, an expandably urged type cylinder or a contractibly urged type cylinder such as a gas cylinder, a pneumatic cylinder, a hydraulic cylinder having a function of accumulating pressure may also be used. In such a case, as shown in FIG. 12 as a sixth example, a cylinder tube 98 of a cylinder 97 may be connected to the lower body 21 while a piston 99 is connected to the rod body 35.

Next, the other examples of constructions for allowing the rod body 35 to follow the piston 30 will now be explained.

As shown in FIG. 13, a protruded portion 100 is integrally formed at the lower end portion of the piston 30, and the upper end portion of the rod body 35 is abutted against the protruded portion 100. Thereafter, both the members are connected to each other by means of a flexible coupling 101.

The flexible coupling 101 is assembled in such a manner that both end portions of a cylindrical body 102 composed of flexible material such as rubber or the like are fitted into the protruded portion 100 and the upper end portion of the rod body 35. Then, the fitted portions are fixed by means of bolts 103, respectively. The flexible coupling 101 may be substituted for an universal joint.

In addition, at a portion of the lower body 21 opposing the connected portion, there is formed an opened window portion 104 through which the connecting or separating operation of the cylindrical body 102 can be easily performed. The opened window portion 104 is normally closed by a cover 105. The piston 30 and the rod body 35 may be formed integrally.

Next, the mechanisms for vertically moving the piston 30 will be explained hereunder.

(FIRST EXAMPLE)

As shown in FIG. 14, a large diameter portion 30*a*, a small diameter rod portion 30*c* positioned at the upper side of the large diameter portion 30*a* and a small diameter rod portion 30*b* positioned at the lower side of the large diameter portion 30*a* are formed with the piston 30 which is slidably inserted into the cylinder bore 23. The upper pressure-receiving chamber 31 has a large pressure-receiving area while the lower pressure-receiving chamber 32 has a small pressure-receiving area.

In addition, a spool 61 is slidably inserted into a spool bore 60 formed in the upper body 20 thereby to constitute a change-over valve 62. A pump port 63, a main port 64 and a tank port 65 are formed in the spool bore 60 while a first pressure chamber 66 and a second pressure chamber 67 are formed at both end sides of the spool 61, respectively.

The spool 61 functions to establish communication between the pump port 63, the main port 64 and the tank port 65 and block communication therebetween. When the spool 61 is pushed and moved to a first position by the pressurized oil filling in the first pressure chamber 66 having a large diameter, the main port 64 and the tank port 65 are connected to each other while communication between the pump port 63 and the main port 64 is blocked.

In contrast, when the spool 61 is pushed and moved to a second position by the pressurized oil filled in the second pressure chamber 67 having a small diameter, the pump port 63 and the main port 64 are connected to each other while communication between the main port 64 and the tank port 65 is blocked.

The tank port 65 is normally connected to a drain port 33 formed in the cylinder bore 23, and the first pressure chamber 66 is connected to an auxiliary port 68 formed in the cylinder bore 23. The auxiliary port 68 is connected to or shut off from the drain port 33 and a first port 70 thereby to constitute a servo valve 71. Further, the main port 64 is connected to a second port 72, and the pressurized oil delivered from a hydraulic pump 73 is supplied to the first port 70 and the pump port 63.

The mechanism described above can also be schematically expressed as shown in FIG. 15. The first port 70 is commonly used in both the servo valve 71 and the lower pressure-receiving chamber 32.

The function of the mechanism is as follows.

When the piston 30 is positioned at an intermediate position as shown FIGS. 14 and 15, the drain port 33, the auxiliary port 68 and the first port 70 are cut off by the action of the switching piston 69. One pressurized oil then fills the first pressure chamber 66, so that the spool 61 takes the first position A, thus the main port 64 is communicated with the tank port 65.

Under these conditions, when the piston 30 is moved upwards (a direction shown by an arrow) within a predetermined distance by the action of the pressurized oil filled in the lower pressure-receiving chamber 32, the small diameter portion 69*a* of the switching piston 69 allows the auxiliary port 68 to connect to the drain port 33, and the pressurized oil filling in the first pressure chamber 66 is supplied to a tank 78. As a result, the spool 61 takes the second position B by the action of a pressure accumulated in the second pressure chamber 67, so that the pump port 63 is communicated with the main port 64.

Due to these operations, when the pressurized oil is supplied to the upper pressure-receiving chamber 31 and the piston is moved downwards in a predetermined distance by the action due to a difference in the pressure-receiving areas between the upper pressure-receiving chamber 31 and the lower pressure-receiving chamber 32. The large diameter rod portion 30*b* of the piston 30 allows the auxiliary port 68 to connect to the first port 70 thereby to supply the pressurized oil to the first pressure chamber 66. Then, the spool 61 of the change-over valve 62 takes the first position A by the action due to a difference in the pressure-receiving areas between the first pressure chamber 66 and the second pressure chamber 67, so that the piston 30 moves upwards. Thereafter, the sequential operations described above are repeated.

(SECOND EXAMPLE)

As shown in FIG. 16, a sub-port 74 is formed in the spool bore 60. A first communicating port 75 and a second communicating port 76 are formed in the cylinder bore 23, respectively. An axial bore 77 is formed in the spool 61, so that the pressurized oil flowed into the pump port 63 flows into the sub-port 74 through the axial bore 77. Then, the pressurized oil flowed out from the sub-port 74 flows into the first pressure chamber 66 through the first communication port 75 and the auxiliary port 68.

The mechanism described above can also be schematically expressed as shown in FIG. 17. The change-over valve 62 is constructed as a four-port and two-position valve. When the change-over valve 62 takes the second position B, the sub-port 74 is communicated with the tank port 65.

Next, the function of this mechanism will be explained hereunder.

When the piston 30 takes an intermediate position shown in FIGS. 16 and 17, the first communication port 75 is connected to the auxiliary port 68, and the pressurized oil flowed out from the pump port 63 flows into the first pressure chamber 66 through the axial bore 77, the sub-port 74, the first communication port 75 and the auxiliary port 68, so that the spool 61 takes the first position A. Then, the pressurized oil flowed out from the upper pressure-receiving chamber 31 flows into the drain port 33 through the second port 72, the main port 64 and the tank port 65, so that the piston 30 moves upwards (a direction shown by an arrow) by the action of the pressurized oil flowed into the lower pressure-receiving chamber 32.

When the piston 30 is moved to an upper stroke end position, the first communication port 75 is shut off and the auxiliary port 68 is connected to the drain port 33, so that the pressurized oil filling in the first pressure chamber 66 flows into the tank 78, and the spool 61 takes the second position B by the action of the pressurized oil filling in the second pressure chamber 67. As a result, the pressurized oil in the pump port 63 flows into the upper pressure-receiving chamber 31 through the main port 64 and the second port 72, so that the piston 30 moves downwards.

When the piston 30 is moved to a lower stroke end position, the first port 70 is communicated with the second communication port 76, so that the pressurized oil flowed out from the auxiliary port 68 flows into the first pressure chamber 66. As a result, the spool 61 takes the first position A, so that the piston 30 moves upwards. Thereafter, the sequential operations described above are repeated.

In this way, the second pressure chamber 67 of the change-over valve 62 is normally connected to the pump port 63 and the first pressure chamber 66 is alternatively connected to the pump port 63 and the drain port 33, so that the spool 61 will not malfunction. Accordingly, the piston 30 can be securely reciprocated.

That is, while the piston 30 is moved downwards from the upper stroke end position by a predetermined distance, the first pressure chamber 66 is connected to the tank 78. Under this condition, even if the pressurized oil filling in the lower pressure-receiving chamber 32 leaks from a clearance between the cylinder bore 23 and the piston 30, a pressure is not generated in the first pressure chamber 66.

In addition, even if the piston 30 is moved downwards to a position further than the predetermined distance thereby to shut off the auxiliary port 68, the pressurized oil leaking from the clearance flows into the tank 78 through the second communication port 76, the first communication port 75, the sub-port 74, the tank port 65 and the drain port 33, so that a pressure is not generated in the first pressure chamber 66. Accordingly, the spool 61 of the change-over valve 62 would not move to the first position A.

(THIRD EXAMPLE)

As shown in FIG. 18, there is provided a low pressure circuit 121 for connecting the upper pressure-receiving chamber 31 of a vibration generator 13 to the tank 78 through a restrictor 120, and a switching valve 122 for connecting/shutting off the low pressure circuit 121 is provided. The change-over valve 122 takes a connecting position j by an urging force of a spring 123, and takes a shutting-off position k when a solenoid 124 is energized.

In a case where the ramming work is performed using such example, the change-over valve 122 is set to take the connecting position j without energizing the solenoid 124. Then, the upper pressure-receiving chamber 31 of the vibration generator 13 is connected to the tank 78 through the restrictor 120. Owing to this operation, a part of the pressurized oil flowed into the upper pressure-receiving chamber 31 flows out to the tank 78 through the restrictor 120, so that the pressure in the upper pressure-receiving chamber 31 would not abruptly increase but moderately increase. Namely, when the piston 30 is moved downward and the ramming plate 38 is in contact with the ground, the pressure in the upper pressure-receiving chamber 31 would not abruptly increase. Accordingly, the apparatus body 14 and the piston rod 12 are not rapidly lifted, so that a large shock or impact would not be applied to the arm, a boom and an upper car body through the pressurized oil contained in a bucket hydraulic cylinder of a working machine, not shown, and the bucket hydraulic cylinder, and thus a riding feeling for an operator can be improved.

Further, in a case where the crushing operation will be performed by using the apparatus to which the basic end portion of the chisel 58 is attached in place of the ramming tool 19 as shown in FIG. 5, the change-over valve 122 is set to the shut-off position k by energizing the solenoid. At this time, communication between the upper pressure-receiving chamber 31 of the vibration generator 13 and the tank 78 is blocked, so that the pressure in the upper pressure-receiving chamber 31 increases to a high level. Accordingly, a force for impacting the basic end portion of the chisel 58 by using the piston 30 becomes large, so that the crushing operation can be efficiently performed.

(FOURTH EXAMPLE)

As shown in FIG. 19, a ramming apparatus of a fourth example is constructed so as to be provided with an auxiliary pressure-receiving chamber 125. Further, the auxiliary pressure-receiving chamber 125 is constructed so as to establish communication between the main port 64 of the change-over valve 62 and the tank 78 so as to be switchable by the action of the change-over valve 126. That is, the change-over valve 126 is switchable to a first position 1 and a second position m. When the change-over valve 126 takes the first position 1, the auxiliary pressure-receiving chamber 125 is connected to the main port 64, and is also communicated with the tank 78 through the restrictor 127. Further, when the change-over valve 126 takes the second position m, communication between the auxiliary pressure-receiving chamber 125 and the main port 64 is blocked, and the auxiliary pressure-receiving chamber 125 is directly communicated with the tank 78.

When the change-over valve 126 is set to the first position 1 at the time of the ramming working, the pressurized oil is supplied to the upper pressure-receiving chamber 31 and the auxiliary pressure-receiving chamber 125. At the same time, the upper pressure-receiving chamber 31 and the auxiliary pressure-receiving chamber 125 are communicated with the tank 78 through the restrictor 127. Accordingly, the piston 30 is pushed downwards by the action of the pressurized oil supplied to both the upper pressure-receiving chamber 31 and the auxiliary pressure-receiving chamber 125, so that the difference between the pressure-receiving area for generating a force to push the piston 30 downwards and the pressure-receiving area for generating a force to push the piston 30 upwards becomes large. As a result, a force i.e., the ramming force for pushing the piston 30 downwards becomes large.

In addition, the upper pressure-receiving chamber 31 and the auxiliary pressure-receiving chamber 125 are communicated with the tank 78 through the restrictor 127, so that the pressures in the both the upper pressure-receiving chamber 31 and the auxiliary pressure-receiving chamber 125 is not abruptly increased, and thus the riding feeling of the operator can be improved in the same manner as in the third example.

Further, in a case where the crushing operation will be performed by using the apparatus to which the chisel 58 is attached as shown in FIG. 5, if the change-over valve 126 is set to the second position m, the auxiliary pressure-receiving chamber 125 is communicated with the tank 78, so that the pressurized oil is supplied only to the upper pressure-receiving chamber 31. Accordingly, the pressure-receiving area for generating a pressure to push the piston 30 downwards becomes small, so that a moving speed of the piston 30 is increased.

In addition, the amount of the pressurized oil to be supplied to the upper pressure-receiving chamber 31 can be increased by an amount corresponding to the amount of the pressurized oil not to be supplied to the auxiliary pressure-receiving chamber 125, so that the pressure in the upper pressure-receiving chamber 31 becomes large. Therefore, the force for impacting the base end portion of the chisel 58 by using the piston 30 becomes large, so that the crushing operation can be efficiently performed.

In the examples described above, the pressurized oil is normally supplied to the lower pressure-receiving chamber 32, and the upper pressure-receiving chamber 31 is supplied with the pressurized oil or connected to the tank so that the piston 30 is vertically moved due to the difference in the pressure-receiving areas of the upper pressure-receiving chamber 31 and the lower pressure-receiving chamber 32. However, the present invention is not limited to such examples, the ramming apparatus can also be constructed so that the upper pressure-receiving chamber 31 and the lower pressure-receiving chamber 32 are alternatively connected to a hydraulic power unit and the tank thereby to vertically move the piston 30.

As described above, according to the hydraulic ramming apparatus of the present invention, since the piston 30 and the rod body 35 of the ramming tool 19 are separately formed, it becomes possible to insert the basic end portion of the chisel 58 in place of the rod body 35, and thus the ramming apparatus can be available not only to the ramming operation but also for a crushing operation.

Further, from the same reason, even if the rod body 35 is inclined against the elastic force of an elastic member when a lateral force is applied to the ramming tool 19 during the ramming working, the lateral force will not be transmitted to the piston 30, so that the sliding portion of the piston 30 will not be damaged.

Furthermore, the piston 30 can be individually worked under a condition of being separated from the ramming tool 19, and the piston 30 can also be individually inserted into the cylinder bore 23, so that it becomes possible to shorten the working time and the assembling time of the ramming apparatus.

Although the present invention has been described with reference to the exemplified embodiments, it will be apparent to those skilled in the art that various modifications, changes, omissions, additions and other variations can be made in the disclosed embodiments of the present invention without departing from the scope or spirit of the present invention. Accordingly, it should be understood that the present invention is not limited to the described embodiments and shall include the scope specified by the elements defined in the appended claims and the scope equivalent to the claims.

What is claimed is:

1. A hydraulic ramming apparatus assembly comprising:

a cylindrical body defining a cylinder bore and a guide bore extending from said cylinder bore, a piston slidably inserted in said cylinder bore so as to be reciprocal therein, and upper and lower pressure-receiving chambers defined between an inner peripheral surface of said cylindrical body and an outer peripheral surface of said piston;

a ramming tool having a rod body which is removably inserted into said guide bore of said cylindrical body;

a chisel which is alternatively removably mounted to said guide bore of said cylindrical body in place of said ramming tool;

a mechanism for mounting said remming tool to said cylinder body and for resiliently biasing moving said rod body toward said piston, said mechanism being removably connected to said cylindrical body to permit removal of said rod body and insertion and coupling of said chisel in said bore; and means for alternately mounting said ramming tool or said chisel in said guide bore.

2. A hydraulic ramming apparatus as claimed in claim 1, wherein said mechanism for moving said rod body is mounted at a first end of said cylindrical body so as to be aligned with said guide bore.

3. A hydraulic ramming apparatus as claimed in claim 2, wherein, upon removal of said mechanism for moving said rod body and said rod body from said cylindrical body, said chisel can be inserted into and secured in said guide bore in a manner such that the chisel will not move in response to movement of said piston away from the chisel.

4. A hydraulic ramming apparatus as claimed in claim 1, wherein said mechanism for moving said rod body comprises:

a spring receiver connected to a first end of said cylindrical body, said spring receiver defining a large cylinder portion engaging said first end of said cylindrical body and a small cylinder portion extending from said large cylinder portion; and a spring disposed in said spring receiver for biasing said rod body into contact with an end face of said piston.

5. A hydraulic ramming apparatus as claimed in claim 1, wherein said rod body of said ramming tool and an upper portion of said chisel are each provided with an elongated recessed portion cooperating with said means for alternatively mounting said ramming tool or said chisel.

6. A hydraulic ramming apparatus as claimed in claim 5, wherein said mounting means comprises a pin rotatably fitted in said cylindrical body and extending through said elongated recessed portion of said ramming body or said chisel so that said pin is received in said elongated recessed portions.

7. A hydraulic ramming apparatus as claimed in claim 6, wherein said pin extends in a direction normal to a longitudinal direction of said rod body or said upper portion of said chisel.

8. A hydraulic ramming apparatus kit comprising:

a cylindrical body defining a cylinder bore and a guide bore extending from said cylinder bore, a piston slidably inserted in said cylinder bore so as to be reciprocal therein, and upper and lower pressure-receiving chambers defined between an inner peripheral surface of said cylindrical body and an outer peripheral surface of said piston;

a ramming tool having a rod body which can be selectively mounted in said guide bore of said cylindrical body;

a chisel which can be selectively mounted in said guide bore of said cylindrical body in place of said ramming tool;

means for alternately mounting said ramming tool or said chisel in said guide bore; and a mechanism connectable to said cylindrical body to mount said ramming tool to said cylinder body and to effect movement of said rod body in a direction toward said piston in response to movement of said piston in a direction away from said rod body, wherein said mechanism can be detached from said cylindrical body to permit removal of said rod body and insertion, coupling and use of said chisel.

* * * * *